United States Patent [19]

Gardner

[11] 4,320,866

[45] Mar. 23, 1982

[54] CONTAINER SLEEVE

[75] Inventor: Jeffrey M. Gardner, Wheaton, Ill.

[73] Assignee: Container Corporation of America, Chicago, Ill.

[21] Appl. No.: 167,676

[22] Filed: Jul. 11, 1980

[51] Int. Cl.[3] ..... B65D 5/04

[52] U.S. Cl. ..... 229/37 R; 229/41 B; 229/1.5 R

[58] Field of Search ..... 229/1.5 R, 37 R, 41 R, 229/41 B, 16 R; 220/408, 410, 470

[56] References Cited

U.S. PATENT DOCUMENTS

| | | | |
|---|---|---|---|
| 920,480 | 5/1909 | Kenny | 229/1.5 R |
| 1,423,272 | 7/1922 | Steudel | 229/16 R |
| 1,498,304 | 6/1924 | Schuster | 229/82 |
| 2,203,687 | 6/1940 | Riubel | 229/16 R |
| 2,651,862 | 9/1953 | Fine | 229/1.5 R |
| 3,726,469 | 4/1973 | Koehler | 229/41 B |

*Primary Examiner*—Herbert F. Ross

*Attorney, Agent, or Firm*—Richard W. Carpenter; Davis Chin

[57] ABSTRACT

A sleeve for a container formed of a unitary blank of paperboard and having co-planar end panels interconnected by a separate connecting panel.

7 Claims, 7 Drawing Figures

CONTAINER SLEEVE

SUMMARY OF THE INVENTION

This invention relates to paperboard packaging and more particularly to a paperboard tubular sleeve which may be used as an inner packing or with an opposed pair of end caps.

It is an object of the invention to provide a tubular liner or sleeve which is simple to erect and uses a minimum amount of sheet material such as paperboard.

Another object of the invention is to provide a tubular sleeve formed of sections joined by diagonal fold lines so that the carton can be formed from a narrower blank than would normally be used, so that it can be processed on a conventional sized printer-slotter machine.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 2:
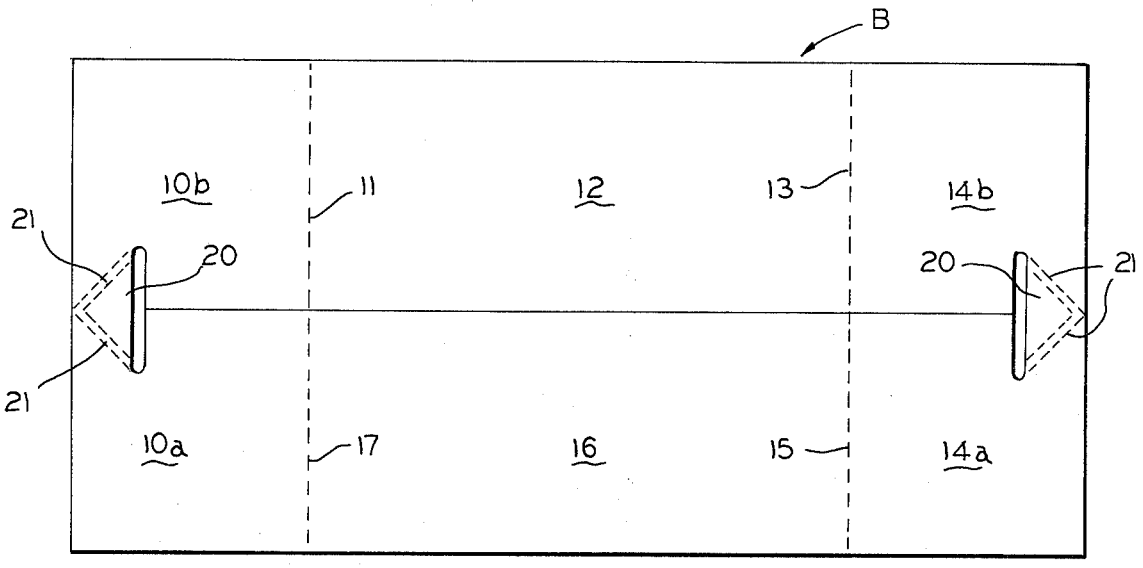
FIG. 2 is a plan view of a blank of sheet material from which the sleeve erected in FIG. 1 may be formed.
Figure 1:
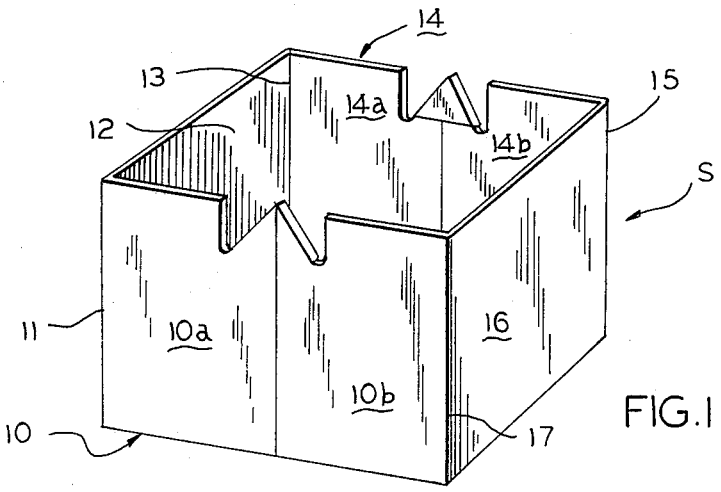
FIG. 1 is a perspective view of an erected sleeve embodying features of the invention.

Referring now to the drawings for a better understanding of the invention, it will be seen that the sleeve, indicated generally at S in FIG. 1, is an open ended tubular structure which may be formed from a rectangular blank B of foldable sheet material illustrated in FIG. 2.

Before describing the invention in detail, it should be understood that the novelty in the invention hereinafter described, resides in the manner in which certain of the side wall panel sections are joined to each other by a connecting member having diagonal fold lines. This novel arrangement has many advantages over the prior art method of forming a sleeve which usually consists of providing four side wall panels joined together in end to end relationship with the adjacent ends of remote panels secured to each other by stitching, taping, or the use of a glue panel.

It will be understood that, in order to form a large container sleeve having side walls which are three or four feet in width, the overall length of the conventional blank would be too wide to be formed on a conventional printer-slotter piece of equipment. This novel construction reduces the width of the blank by 50% so that a large blank can be accommodated on a conventional machine.

This novel arrangement also eliminates the need for any gluing, stitching or taping, as manufacturer's joint is required.

Also if the side wall panels of the desired container are of very small dimensions from top to bottom, it is extremely difficult to handle in conventional equipment. Again, by doubling the top to bottom dimensions of the blank, it is easier for it to be handled on conventional equipment.

Figure 3:
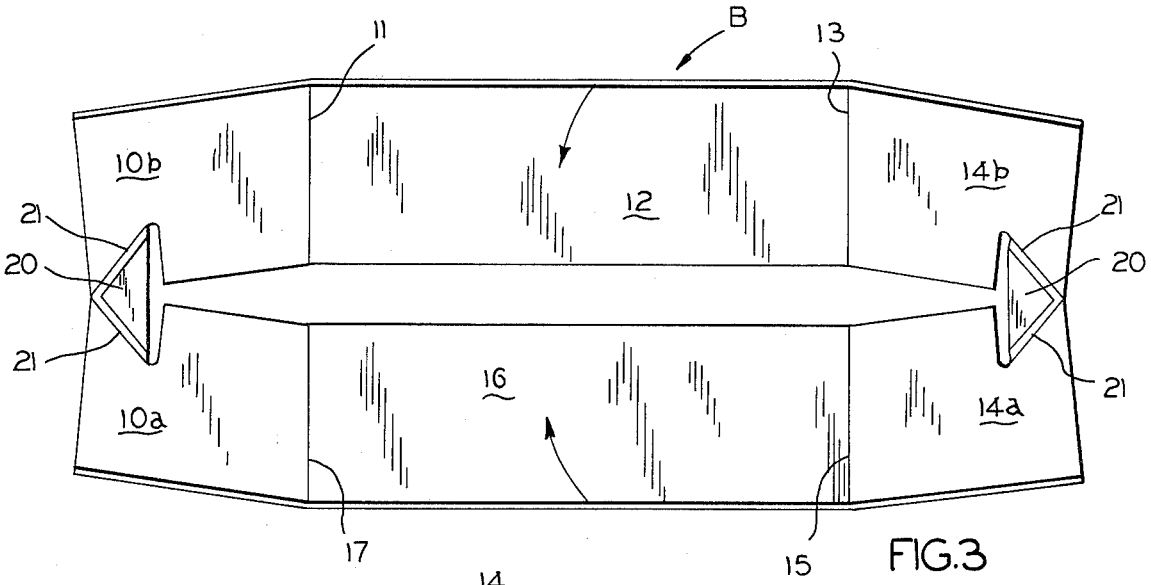
FIG. 3 is a view similar to FIG. 1 but illustrating one step in the formation of the erected sleeve.

It will be seen that the structure illustrated in FIGS. 1–3 includes four side walls 10, 12, 14 and 16 which are foldably joined to each other along fold lines 11, 13, 15 and 17, respectively, to form a tubular structure open at the ends.

It will be noted that opposed side wall panels 10 and 14 each include a pair of co-planar panel sections **10*a*, 10*b* and 14*a*, 14*b*, respectively. Panels 10*a* and 10*b* are disposed in co-planar relationship with their remote edges foldably joined to adjacent side wall panels 12 and 16 and with their adjacent edges disposed in abuting relationship, but free from direct connection to each other. Panels 10*a* and 10*b* are connected to each other by a relatively small connecting panel 20. Panel 20 is generally triangular in shape and is disposed to lie against the inner surfaces of adjacent portions of panel 10*a* and 10*b*. Panel 20 has outwardly converging side edges which are foldably joined on diagonal score lines 21 to corresponding outwardly converging edges of panels 10*a* and 10*b*. The same construction is applied to panels 14*a* and 14*b* which are likewise joined by a connecting panel 20**.

Thus, in order to erect the structure of FIG. 1 from the blank of FIG. 2, the two halves of the blank are folded toward each other and as this occurs, the panel sections of panels 10 and 14 are folded toward each other as the connecting panels 20 are brought into face-to-face relation with the adjacent surfaces of panels 10 and 14. The other embodiments of the invention hereinafter described utilize the same basic principle but have slightly different additional features.

Figure 5:
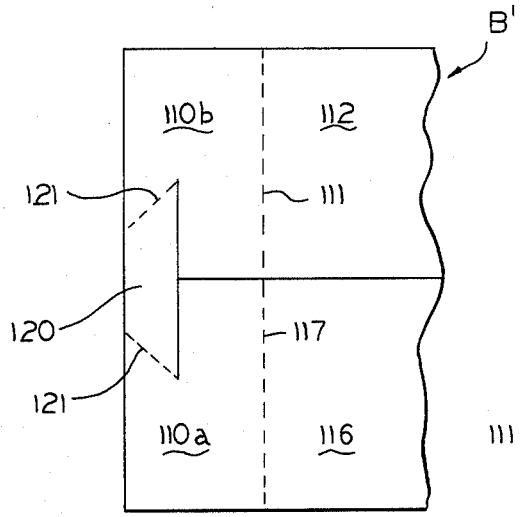
FIG. 5 is a fragmentary plan view of a portion of a blank from which the structure of FIG. 4 may be formed.
Figure 4:
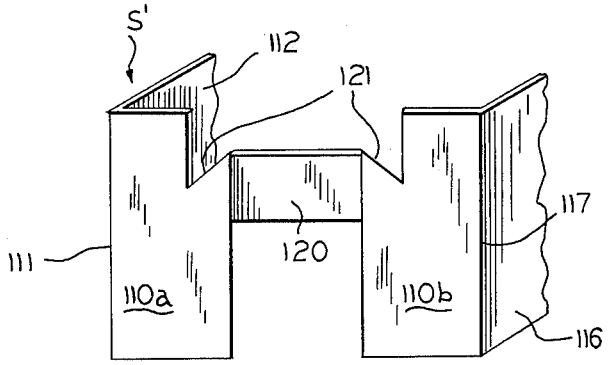
FIG. 4 is a fragmentary, perspective view of another embodiment of the invention.

The sleeve S′ of FIG. 4 may be formed from the blank B′ of FIG. 5. Elements of the structure which correspond to the previous embodiment have been designated with related numerals. This embodiment is different from the previously described embodiment by virtue of the fact that the connecting panels 120 instead of being triangular are trapezoidal in shape. Thus the adjacent edges of panel sections **110*a* and 110*b*** are spaced from each other rather than in abuting relationship. Thus by this arrangement a sleeve of even larger circumference can be formed from the blank.

Figure 7:
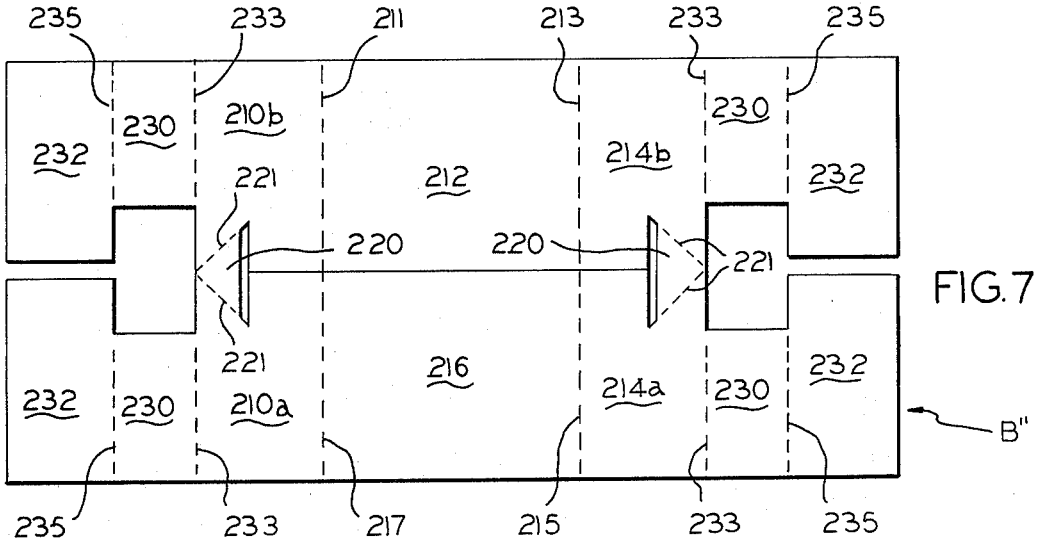
FIG. 7 is a plan view of a blank of sheet material from which the structure of FIG. 6 may be formed.
Figure 6:
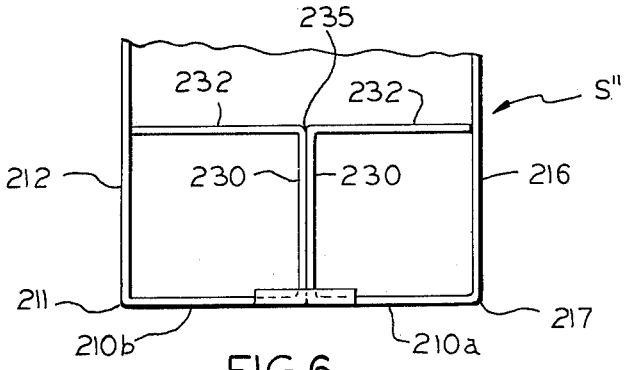
FIG. 6 is a fragmentary, plan view of a portion of a structure embodying another form of the invention.

Turning now to FIGS. 6 and 7, it will be seen that a slightly modified form of the invention is shown. In this embodiment sleeve S″ may be formed from blank B″. Again, portions of the structure which correspond to those of the first described embodiment are identified by similar numerals. The central portion of the blank of this embodiment is the same as that of the first embodiment. The additional feature of this embodiment is, however, the added partition panels 230 and 232 which are provided at the four corners of the blank. Panel 230 is connected to the adjacent panel section along fold line 233 and panel 232 is foldably joined to panel 230 along fold line 235.

The sleeve is erected in the same manner except that each set of first partition panels 230 is folded together in face-to-face relation and each second set of partition panels 232 is folded at right angles to first partition panels and in end to end relationship with each other to provide a pair of cells at each end of the container. These cells may be used for separating packaged products from each other or to provide additional strength.

Thus, it will be appreciated that in each of the embodiments a sleeve is provided from a rectangular blank of half the width of a normal blank, and this is accomplished by the novel connecting panel arrangement utilizing disgonal scores.

I claim:

1. A sleeve formed of a generally rectangular, unitary blank of paperboard, for use in a shipping container, comprising:

(a) opposed pairs of side wall panels foldably joined to each other to form a tubular structure open at the ends;

(b) each side wall panel of one of said pairs including a pair of co-planar panel sections having remote edges foldably joined to adjacent side wall panels and having adjacent edges free from direct attachment to each other;

(c) said panel sections having adjacent end portions joined to each other by a connecting panel which is disposed against said end portions and which has a pair of outwardly converging edges foldably joined on diagonal score lines to related outwardly converging edges of said panel sections.

2. A sleeve according to claim 1, wherein said panel section adjacent edges are disposed in abutting relation with each other.

3. A sleeve according to claim 1, wherein said panel section adjacent edges are spaced from each other.

4. A sleeve according to claim 1, wherein said outwardly converging edges of said connecting panel and of said panel sections converge at the juncture of said panel section adjacent edges and the outer edges of said panel sections.

5. A sleeve according to claim 1, wherein said connecting panel is generally triangular.

6. A sleeve according to claim 1, wherein said connecting panel is trapezoidal.

7. A sleeve according to claim 1, and including:

(a) a pair of first inner partition panels foldably joined to respective panel section adjacent edges and extending normal thereto in face-to-face relation with each other;

(b) a pair of second inner partition panels foldably joined to respective first inner partition panels and extending normal thereto in end-to-end relation with each other.

* * * * *